United States Patent [19]

Minkin

[11] 4,213,475

[45] Jul. 22, 1980

[54] POWER PARTS WASHER

[76] Inventor: Gary E. Minkin, 12528 Post Grove, St. Louis, Mo. 63141

[21] Appl. No.: 9,168

[22] Filed: Feb. 5, 1979

[51] Int. Cl.[2] ..... B08B 3/02

[52] U.S. Cl. ..... 134/111; 134/148

[58] Field of Search ..... 134/111, 148, 200

[56] References Cited

U.S. PATENT DOCUMENTS

| | | | |
|---|---|---|---|
| 1,907,411 | 5/1933 | Timoney | 134/111 X |
| 2,721,566 | 10/1955 | Brucker | 134/111 X |
| 3,054,411 | 9/1962 | Randall | 134/148 X |
| 3,439,689 | 4/1969 | Zadron et al. | 134/111 X |
| 3,921,653 | 11/1975 | Ducharme | 134/111 X |
| 4,143,669 | 3/1979 | Minkin | 134/200 X |

FOREIGN PATENT DOCUMENTS

| | | | |
|---|---|---|---|
| 645968 | 7/1964 | Belgium | 134/111 |

*Primary Examiner*—Robert L. Bleutge

*Attorney, Agent, or Firm*—Wegner, Stellman, McCord, Wiles & Wood

[57] ABSTRACT

A power parts washer having a cabinet with a washing chamber and a sump therebeneath and a liquid circulating system including a plurality of spray nozzles in said chamber. The liquid circulating system includes structure to circulate grit taken from parts being washed for improved cleaning action, with the structure including a coarse filter in the sump in advance of the intake section thereof whereby grit of a certain size may pass through the filter for intake into the circulating system. The spray nozzles have openings of a size and shape to permit flow therethrough of liquid and entrained grit which has passed through the filter.

4 Claims, 3 Drawing Figures

POWER PARTS WASHER

BACKGROUND OF THE INVENTION

This invention pertains to power parts washers for automotive parts and the like, with improved cleaning action of the parts because of the cleaning liquid also having grit therein which is emitted from the spray nozzles against the parts.

Power parts washers are known in the art and generally have a liquid circulating system including spray nozzles which direct heated liquid containing a chemical, such as detergent, against parts in a washing chamber. An example of such a unit is shown in my pending application, Ser. No. 805,305, filed June 10, 1977 now U.S. Pat. No. 4,143,669, entitled Power Parts Washer. These prior units have had a sump which collects the liquid from the washing chamber. The sump has an intake section wherein the liquid is drawn from the sump by a pump for delivery through the system and to the spray nozzles. Such devices have had a fine filter screen to block out all particles of any size and prevent their entry into the liquid circulating system. These fine filter screens function to block grit out of the system and to thereby avoid plugging up the spray nozzles. Over a period of time, sufficient grit will be carried through the circulating system as to plug up the spray nozzles and, at this time, the unit has to be cleaned out and recharged with liquid and chemical.

SUMMARY OF THE INVENTION

This invention pertains to a power parts washer constructed to utilize grit which is in the liquid for improved cleaning action of the parts and without such grit causing clogging of the spray nozzles.

In carrying out the invention, the power parts washer has a washing chamber with a sump therebeneath. The sump has an intake section wherein an inlet of the liquid circulating system is located to draw liquid from the sump and direct it to the spray nozzles within the washing chamber for blasting thereof against parts within the washing chamber. Filter means, including at least one relatively coarse filter, is positioned within the sump in advance of the intake section, to filter out substantially oversize particles, but to let most of the grit obtained from washing of the parts pass through the filter into the circulating system. To avoid clogging of the spray nozzles, they have shaped openings of a size greater than the pores of the coarse filter whereby only grit of a size less than the openings in the spray nozzles may be delivered thereto.

in a power parts washer using a liquid with a chemical, such as detergent, the water becomes somewhat heavier and it is found that the grit tends to lie at an intermediate level of the liquid within the sump and, therefore, the inlet for the liquid circulating system is located approximately at a midlevel of the sump to intake water which is rich in grit.

The grit washed off of parts in the parts washer can be many different materials, such as sand or carbon particles when parts being washed are automobile engine parts, and these particles will not emulsify, but remain as discrete particles within the cleaning liquid.

DESCRIPTION OF THE PREFERRED EMBODIMENT

Figure 1:
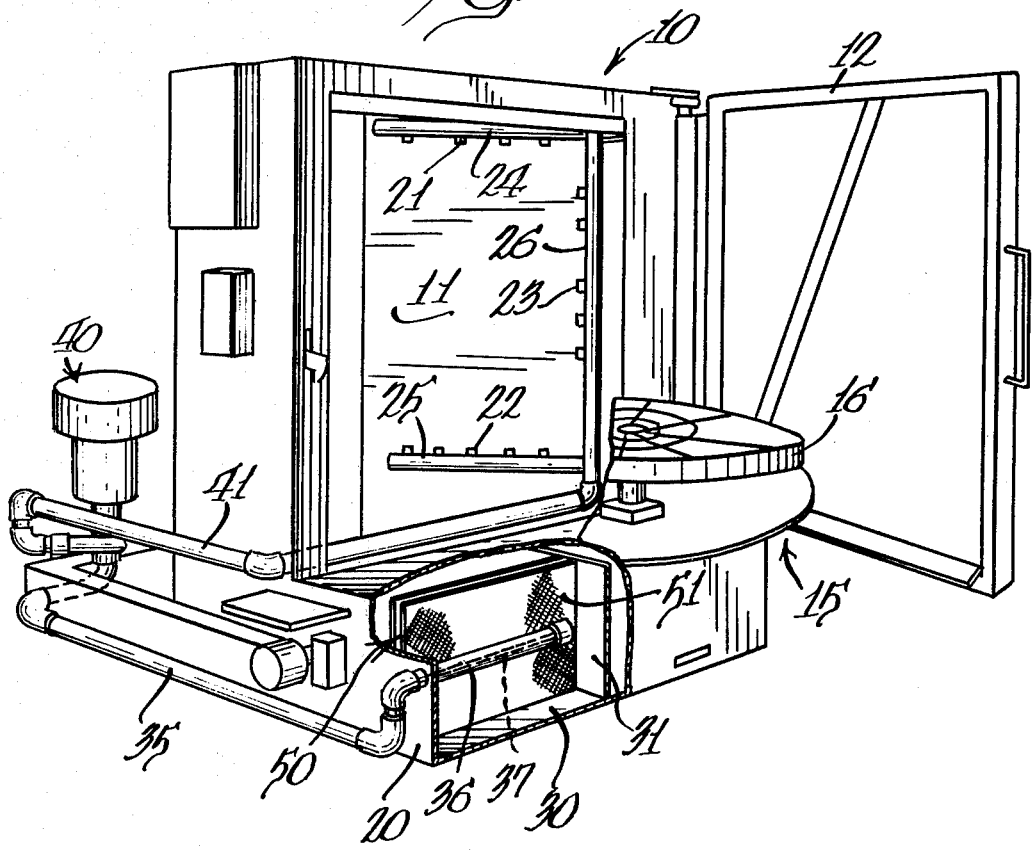
FIG. 1 is a perspective view of the power parts washer with the front door thereof in open position and with a portion of the sump broken away.

The power parts washer is shown generally in FIG. 1 wherein a cabinet 10 has a washing chamber 11 defined interiorly thereof. A hinged door 12 is shown in open position and can be moved into position against the cabinet walls to close the washing chamber. A turntable structure, indicated generally at 15, is mounted to the door 12 for movement therewith. Parts to be washed, such as automobile parts, can be placed on a rotatable turntable member 16. The turntable moves into the washing chamber as the door is closed.

The cabinet has a lower generally rectangular part 20 thereof defining a sump which receives washing liquid from the washing chamber through an opening (not shown) at the base of the washing chamber.

The foregoing structure is more particularly described in my prior pending application, Ser. No. 805,305, filed June 10, 1977 and the disclosure thereof is incorporated herein by reference.

Spray means within the washing chamber include upper and lower horizontally-spaced sets of nozzles 21 and 22, respectively. Additionally, there is a vertically-spaced row of nozzles 23. These nozzles are mounted on interconnected pipe sections 24, 25 and 26, respectively, forming part of a fluid circulating system. Although the nozzles disclosed herein are of a different construction from those shown in my prior pending application, reference may be made to said prior application for a specific description regarding the spacing and location of the nozzles for optimizing the washing operation.

The sump 20 has an intake section 30 defined by part of the cabinet walls and an internal wall 31 which provides for intake of liquid from the sump into the fluid circulating system.

The fluid-circulating system includes conduit means including a first conduit 35 having an inlet section 36 positioned within the intake section and extending to a power-driven pump, indicated generally at 40. The inlet section 36 is shown as a length of pipe, with a longitudinally-formed opening 37 therein.

A second conduit 41 extends from the outlet of the pump 40 and connects to the nozzle mounting pipes 24–26.

In washing of parts, such as automobile parts, the presence of grit in the washing liquid collected in the sump is quite common. This grit comes off the parts being washed and is in the form of discrete particles. The actual nature of the particles depends upon the type of soil removed from the parts. Quite frequently, the particles are sand or carbon material derived from engine carbon. The accepted practice in the past has been to use fine filtering in the sump in advance of the intake section to prevent entry of grit into the circulating system because of resulting clogging of the nozzles. Ultimately, the nozzles have become clogged and the circulating system and nozzles are cleaned out and the washing liquid replaced to place the washer back in operation. Contrary to past practice, the parts washer disclosed herein utilizes the grit to improve the cleaning action. The grit is not abrasive, but gives a scouring or polishing action during the washing of the parts.

The normal washing liquid is heated water with an added chemical, such as a detergent. This detergent normally places the washing liquid on the plus side of $ph_7$, which tends to make the water heavier, with the result that the grit floats at an intermediate level of the liquid contained in the sump.

Figure 3:
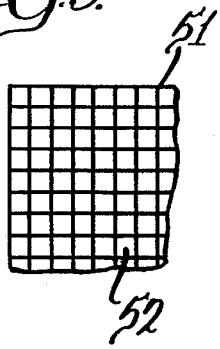
FIG. 3 is a fragmentary plan view of a coarse filter used in the sump of the power parts washer.

In order to utilize the grit, the filter means, indicated generally at 50 in the sump in advance of the intake section 30 does not have any fine filter and comprises at least one relatively coarse filter 51. The coarse filter is shown diagrammatically in FIG. 3 to illustrate pores 52 therein through which liquid and grit can pass. The pores are selected of a size to allow passage of all grit of less than approximately ¼" diameter, but to block passage of larger particles. Although the filtering size of the pores can vary from this value, such a value does define a coarse filter. In prior washers, a fine filter has been used to prevent passage of grit, with pores in such filters being in the range of 0.010–0.020". Although the coarse filter pores can vary in size from ¼" diameter, the size thereof is greatly in excess of the size of fine filter pores.

Figure 2:
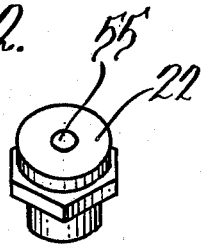
FIG. 2 is a perspective view of a spray nozzle used in the power parts washer.

With the flow of heated liquid and grit to the spray nozzles 21–23, the spray nozzles are provided with an opening or orifice of a size greater than the pore size of the filter 51. A nozzle 22 is shown in FIG. 2 and has an opening 55. This opening is round to facilitate passage of grit therethrough and is of a diameter greater than the size of grit that can pass through the filter 51. The prior art nozzles have had openings or orifices which have had a long, oval shape which further contributed to blockage thereof.

Because of the suspension of the grit at an intermediate level of the liquid in the sump, the intake section 36 is at a lower level than in prior art parts washers and is now positioned at an intermediate level. Analysis has shown that different conditions exist at three levels of the sump. The lowermost level is generally a sludge which drops out of solution. The top level is water, relatively free of grit, and the intermediate level is water with entrained grit. The location of the intake section at this intermediate level in the intake section of the sump assures the intake of water which is rich in grit.

I claim:

1. A power parts washer for automotive parts and the like having a cabinet with a washing chamber and a sump therebeneath, spray means including a plurality of nozzles in said chamber, and a fluid circulating system for drawing fluid from said sump and delivering the fluid to said nozzles with said fluid including grit in the form of relatively large particles washed from parts being cleaned comprising, conduit means having a pump connected thereto extended between the sump and nozzles, and filter means positioned in said sump beneath the level of fluid in the sump and having coarse filters only with pores of a size to permit grit up to approximately ¼" diameter to pass therethrough to provide coarse filtering only of fluid flowing to said fluid inlet, said pump having a fluid inlet positioned at an intermediate level in said sump to be at a level of fluid which contains said grit and downstream of said filter means, and said nozzles each having an opening of a size greater than the size of the grit which passes through said filter means.

2. A power washer as defined in claim 1 wherein said nozzle openings are of at least ¼" diameter.

3. A power parts washer for automotive parts and the like having a cabinet with a washing chamber and a sump therebeneath, spray means in said washing chamber including a plurality of spray nozzles for directing a liquid including a chemical such as a detergent against parts in said chamber with the liquid thereafter flowing to said sump and including grit in the form of large particles removed from the parts being washed, a first conduit having an inlet positioned in an intake section of said sump, a pump connected to said first conduit, a second conduit extended between said pump and said spray means, filter means consisting of one or more coarse filters positioned in said sump to filter liquid flowing to said intake section and having relatively large pores of a size of up to approximately ¼' diameter to permit flow of grit therethrough, and said spray nozzles each having an approximately round opening of a diameter greater than that of the grit which passes through the filter to permit flow of liquid and grit out of the nozzles.

4. A power washer as defined in claim 3 wherein said first conduit inlet is downstream of said coarse filters and is positioned approximately mid-way between the top and bottom of the sump to be at a liquid level which is rich in grit.

* * * * *